US009936805B2

(12) United States Patent
McGregor

(10) Patent No.: US 9,936,805 B2
(45) Date of Patent: Apr. 10, 2018

(54) ADJUSTABLE ROTARY SHELF ASSEMBLY FOR A CORNER CABINET AND METHOD OF USE

(71) Applicant: Hardware Resources, Inc., Bossier City, LA (US)

(72) Inventor: Dennis McGregor, Dallas, TX (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

(21) Appl. No.: 14/462,079

(22) Filed: Aug. 18, 2014

(65) Prior Publication Data

US 2016/0045039 A1 Feb. 18, 2016

(51) Int. Cl.
*A47B 49/00* (2006.01)
*A47F 5/02* (2006.01)

(52) U.S. Cl.
CPC ..... *A47B 49/006* (2013.01); *A47B 49/004* (2013.01); *A47F 5/02* (2013.01)

(58) Field of Classification Search
CPC ..... A47B 49/004; A47B 49/006; A47F 5/02; A47F 3/10
USPC ..... 248/125.9, 354.3
See application file for complete search history.

(56) References Cited

U.S. PATENT DOCUMENTS 799,233 A * 9/1905 Hubbell ..... A47B 49/004 108/105
1,448,253 A * 3/1923 Bodker ..... A47B 49/004 211/131.1
2,244,950 A * 6/1941 Jones ..... A47B 49/004 211/1
2,498,459 A * 2/1950 Schroetter ..... G10D 3/003 16/19
2,541,793 A * 2/1951 Thompson ..... E04G 25/06 248/354.3
3,027,140 A * 3/1962 Holzbach ..... E04G 25/06 248/354.3
3,228,646 A * 1/1966 Lane ..... E04G 25/04 248/200.1
3,398,933 A * 8/1968 Haroldson ..... A47B 91/022 248/354.3

(Continued)

FOREIGN PATENT DOCUMENTS

EP 0683996 A2 * 11/1995 ..... A47B 49/006

*Primary Examiner* — Stanton L Krycinski
(74) *Attorney, Agent, or Firm* — Schultz & Associates, P.C.

(57) ABSTRACT

A vertically adjustable rotary shelf assembly for use within a corner cabinet is provided. The shelf assembly includes an inner pole telescopically engaged with an outer pole. Disc shaped shelves are adjustably attached. A first height adjustment assembly provides a "macro" adjustment between the inner pole and the outer pole. A second height adjustment assembly provides a "micro" adjustment. The second height adjustment provides a shaft having a threaded section, a thumbwheel threadably engaged with the threaded section, and a two lobed cam. Rotation of the thumbwheel adjusts the vertical position of the outer pole, the shelves, and an attached cabinet face to align the cabinet face with the adjacent cabinets. A flexible cam follower is provided. The flexible cam follower engages the two lobed cam to bias the cabinet face in a "home" position.

16 Claims, 5 Drawing Sheets

(56) References Cited

U.S. PATENT DOCUMENTS 3,762,116 A * 10/1973 Anderson ..... E04B 2/7444 160/135
3,877,191 A * 4/1975 Munsey ..... E04B 2/7444 439/209
3,927,863 A * 12/1975 Polsky ..... B66F 3/18 248/354.3
3,982,800 A * 9/1976 Gorton ..... A47B 49/006 312/135
4,026,079 A * 5/1977 Morris ..... E04G 1/14 182/180.1
4,056,254 A * 11/1977 Tooley ..... E04G 25/04 248/354.3
4,122,645 A * 10/1978 Tooley ..... E04G 25/04 248/354.3
4,181,037 A * 1/1980 Boon ..... A47B 49/006 108/105
4,431,238 A * 2/1984 Evans ..... B41J 11/58 312/125
4,433,885 A * 2/1984 Baker ..... A47B 49/006 312/125
4,486,106 A * 12/1984 Benting ..... A47B 49/006 312/305
4,572,595 A * 2/1986 Craig ..... A47B 49/004 108/141
4,587,908 A * 5/1986 DeBruyn ..... A47B 49/006 108/142
4,616,940 A * 10/1986 DeBruyn ..... A47B 49/006 312/305
4,632,474 A * 12/1986 Ingersoll ..... A47F 7/02 312/125
4,688,686 A * 8/1987 Mitts ..... A47B 49/006 211/183
5,279,429 A * 1/1994 Sagel ..... A47B 49/006 211/131.1
5,312,003 A * 5/1994 Domenig ..... A47B 49/004 211/131.1
6,017,108 A * 1/2000 Domenig ..... A47B 49/006 312/135
6,626,305 B2 * 9/2003 Domenig ..... A47B 57/26 211/129.1
6,991,305 B2 * 1/2006 Gallea ..... A47B 57/18 312/238
RE39,917 E * 11/2007 Domenig ..... 211/129.1
7,503,529 B2 * 3/2009 Bartelsmeyer ..... A47C 19/005 248/125.9
8,167,152 B1 * 5/2012 Gatti ..... E04B 2/7435 211/187
8,297,011 B2 * 10/2012 Quick ..... E05C 19/003 248/354.3
8,356,953 B2 * 1/2013 Sagel ..... A47B 49/004 211/144
8,459,474 B2 6/2013 Sagel
2004/0040479 A1 * 3/2004 Searer ..... A47B 96/02 108/92
2005/0194873 A1 * 9/2005 Hoffman ..... A47B 49/006 312/305
2006/0137375 A1 * 6/2006 Lishman ..... A47B 49/004 62/258
2006/0169187 A1 * 8/2006 Hoffman ..... A47B 49/006 108/103
2009/0230069 A1 * 9/2009 Naden ..... A47B 49/004 211/144
2010/0108629 A1 * 5/2010 Domenig ..... A47B 49/004 211/151
2011/0127228 A1 * 6/2011 Sagel ..... A47B 49/004 211/144

* cited by examiner

ADJUSTABLE ROTARY SHELF ASSEMBLY FOR A CORNER CABINET AND METHOD OF USE

FIELD OF THE DISCLOSURE

This disclosure relates to cabinet shelving assemblies. In particular, the disclosure relates to a rotary shelf assembly known as a "Lazy Susan," designed to be located in a corner cabinet and which is capable of height adjustment.

BACKGROUND OF THE DISCLOSURE

Corner cabinets present a problem of an inaccessible space. Rotary shelf assemblies, as known in the art, offer one way to use the inaccessible space. Such shelf assemblies are generally circular and pivot to provide a way to reach items placed in the inaccessible space.

Although useful, prior art rotary shelf assemblies are not completely satisfactory. For example, a leveling of the rotary shelf assemblies during installation continues to be a problem. Also, adjusting the rotating shelves to properly align with the cabinet face is difficult and time consuming.

U.S. Pat. No. 8,459,474 to Sagel discloses a rotary fitting for a corner cabinet. The device comprises a supporting column having a main tube supporting shelves. Length adjustment is provided by a support element fixed in the main tube, a recess in the fixed element, and a threaded riser fitted to the recess. The threaded riser comprises a complex threaded shaft engaged with a nut seated in the fixed element. An access "window" is provided in the main tube which allows rotation which in turn allows height adjustment. The height adjustment is limited due to the small access window. Further, the size of the access window does not allow tightening or adjustment with tools.

Therefore there is a need for a rotary shelf assembly that is simple to install and align, comprises few parts, and is easy to manufacture.

SUMMARY

The apparatus disclosed is an adjustable rotary shelf assembly designed to be adjustably mounted within a corner cabinet. The apparatus provides a height adjustment to ensure correct alignment with the cabinet carcass. Height adjustment is preferably accomplished without the use of tools, but may also employ tools when required for challenging installations.

In one embodiment, the apparatus is comprised of an outer pole telescopically engaged with an inner pole. The inner pole is engaged with and rotates within an upper bracket attached to the ceiling of the corner cabinet carcass. The outer pole is seated in and capable of rotating within a lower bracket mounted to the floor of the corner cabinet carcass. A cam lock mechanism adjustably fixes the position of the inner pole with respect to the outer pole. One or more semi-circular shelves are supported by the outer pole with cross-pins. The shelves are fixed with respect to the outer pole and rotate with the inner and outer poles. In a preferred embodiment, each shelf includes a pie-shaped cutout. The shelves also support an angular cabinet door to accommodate the cabinet corner.

A height adjustment assembly connects the outer pole to the lower bracket. The height adjustment assembly is comprised of a shaft engaged with the outer pole, a threaded section of the shaft, a thumbwheel threadably engaged with the threaded section of the shaft and abutting the outer pole, and a cam engaged with the shaft and pivotably supported within the lower bracket. Rotation of the thumbwheel moves the thumbwheel vertically along the threaded section of the shaft. By virtue of the thumbwheel's position adjacent the outer tube, vertical displacement of the thumbwheel moves the outer tube vertically. The cam engages a cam follower attached to the lower bracket. The cam and the cam follower releasably fix the apparatus in a "home" position such that the corner door member completes the cabinet facade to conceal the contents of the shelves. Elasticity of the cam follower allows a rotation of the cam and the shelves and also provides bias toward the defined "home" position.

BRIEF DESCRIPTION OF THE DRAWINGS

Reference will now be made to the drawings, wherein like parts are designated by like numerals, and wherein.

DETAILED DESCRIPTION

Figure 1:
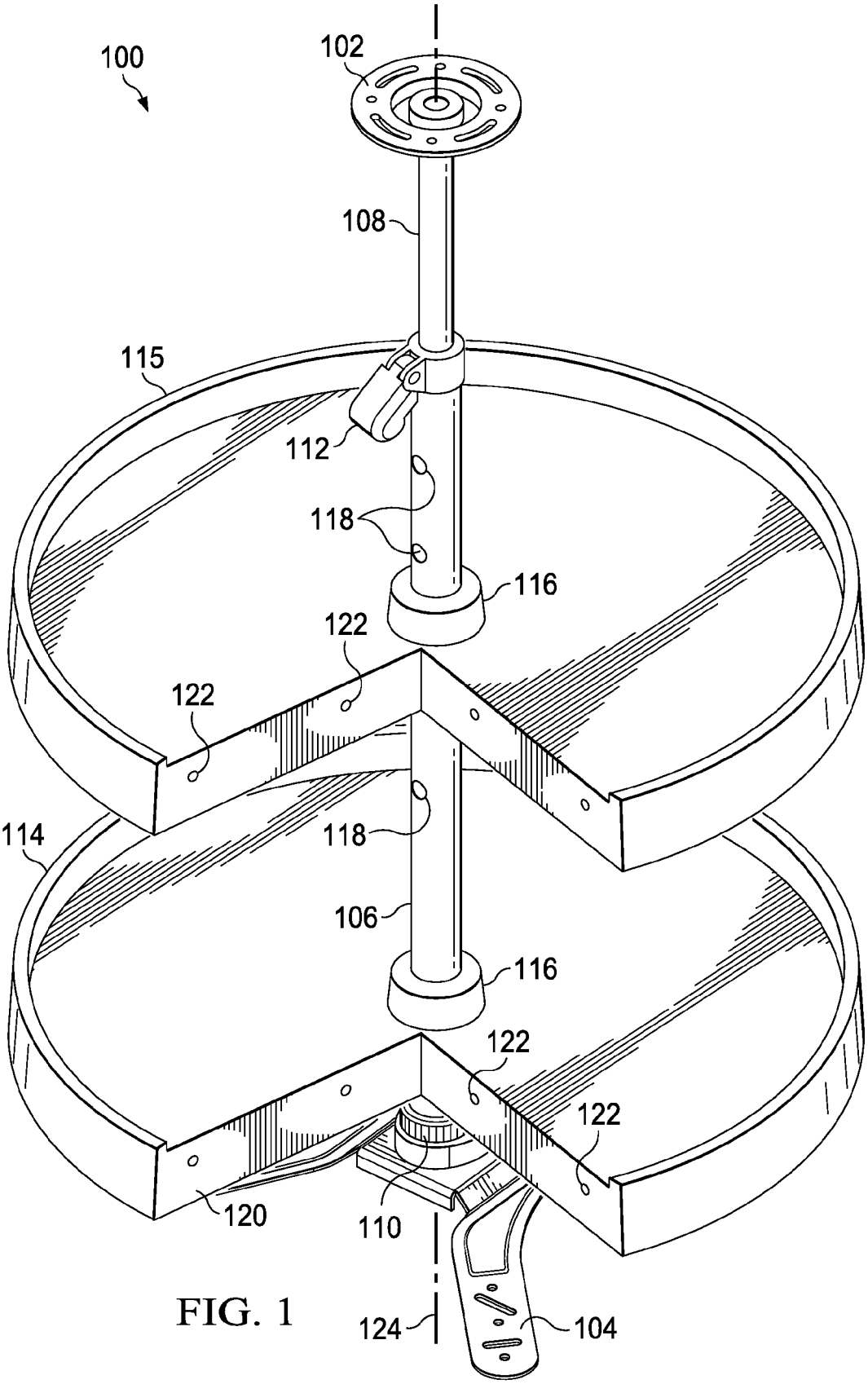
FIG. 1 is an isometric view of an adjustable rotary shelf assembly.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Referring to FIG. 1, rotary shelf assembly 100 is provided. Rotary shelf assembly 100 is comprised of a rotatable and height adjustable central column supporting semi-circular shelves. Rotary shelf 100 rotates about longitudinal axis 124 of the central column. The central column is comprised of inner pole 108 and outer pole 106. Inner pole 108 is telescopically engaged with outer pole 106. Inner pole 108 is rotatably engaged with upper bracket 102. Outer pole 106 is engaged with height adjustment assembly 110. Height adjustment assembly 110 is rotatably supported in lower bracket 104. Height adjustment assembly 112 comprises a cam lock connection mechanism to releasably fix the telescopic engagement of inner pole 108 with respect to outer pole 106. Upper bracket 102 is configured to be mounted on a ceiling portion of the corner cabinet while lower bracket 104 is mounted to a floor portion of the corner cabinet carcass.

Rotary shelf assembly 100 includes base shelf 114 and preferably an additional adjustable shelf 115. In alternate embodiments rotary shelf assembly 100 does not include adjustable shelf 115 or may include a plurality of adjustable shelves 115. Each shelf 114 and 115 is generally semi-circular shaped and each comprises collar 116 and cutout 120. In one embodiment, cutout 120 is made at a radial 90° angle and extends from collar 116 to the edge of the shelf. Other radial angles can be employed to accommodate acute or obtuse cabinet face angles. Cutout 120 includes holes 122 used to mount a decorative cabinet corner face (not shown). The angular cabinet door is visible and is preferably aligned with the cabinet face when the rotary shelf assembly is in a "home" position.

Adjustable shelf 115 is supported on outer pole 106 with cross-pins (not shown) through holes 118 in outer pole 106 as is common in the art. Each hole 118 and 228 includes an equal opposing hole on the opposite side of outer pole 106. The cross-pins extend slightly from each side of outer pole 106 and engage collar 116 and ensure the shelf rotates with outer pole 106. Each hole 118 represents an alternate position for adjustable shelf 115. Base shelf 114 is supported on outer pole 106 in a similar fashion with cross-pin 216 through hole 228, as will be further described below.

Figure 2:
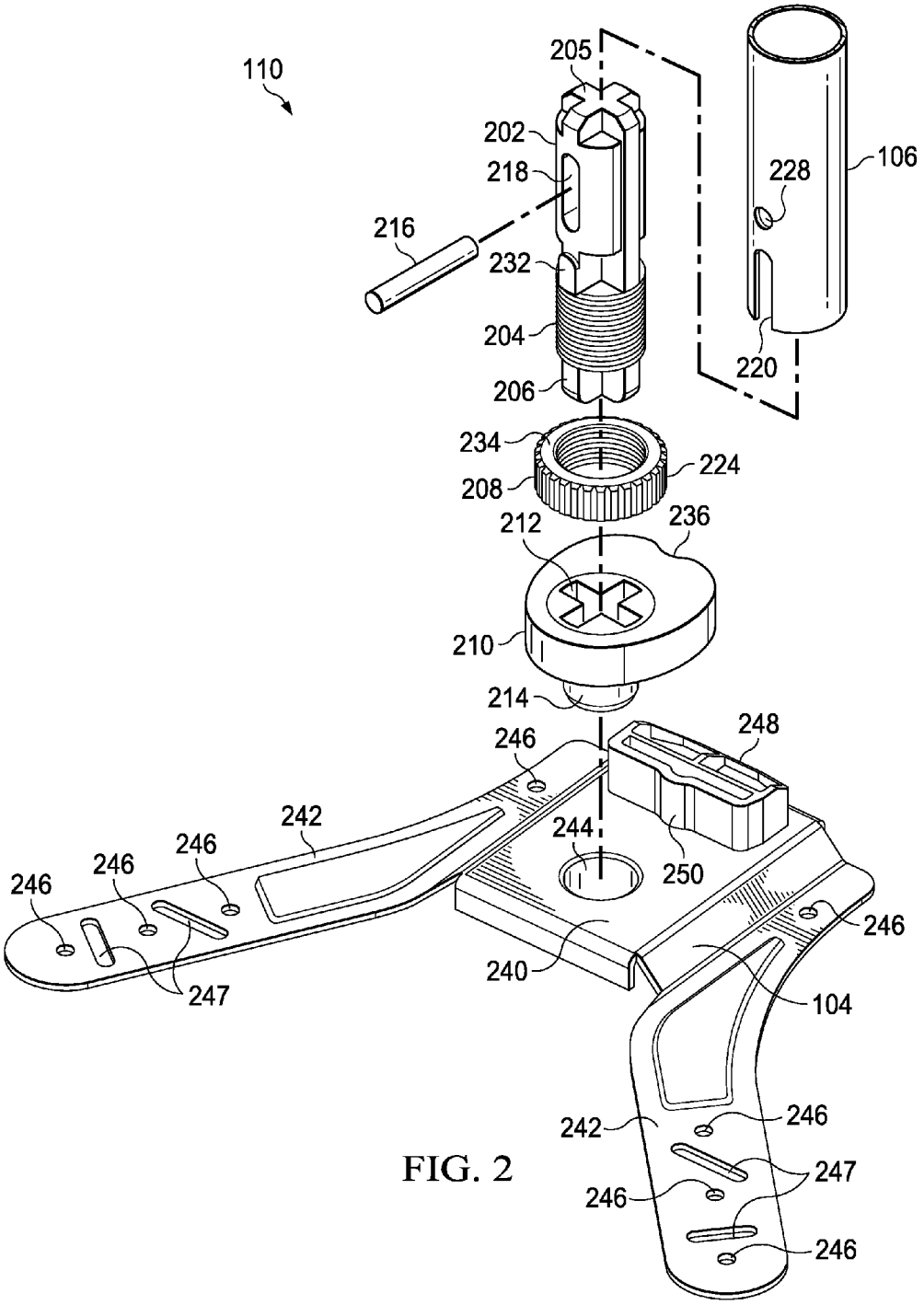
FIG. 2 is an exploded isometric view of a height adjustment assembly.

Referring to FIG. 2, height adjustment assembly 110 includes shaft 202, thumbwheel 208, and cam 210. Shaft 202 engages outer pole 106. Shaft 202 is generally cylindrical in shape and includes ends 205 and 206. In a preferred embodiment, ends 205 and 206 form a cross intersection. Between ends 205 and 206, shaft 202 includes threaded section 204, tab 232, and slot 218. Threaded section 204 is integrally formed in shaft 202 proximate end 206. Slot 218 has a longitudinal axis generally parallel with the longitudinal axis of shaft 202. The width of slot 218 is sized to allow cross-pin 216 to slide through the length of slot 218. Tab 232 is sized to engage slot 220 located on the lower end of outer pole 106 to prevent rotation between outer pole 106 and shaft 202 and to maintain cross-pin 216 aligned with slot 218.

Thumbwheel 208 is generally cylindrical. The interior surface of thumbwheel 208 includes threads sized to threadably engage threaded section 204. In a preferred embodiment, the threads are locking threads to prevent unintended rotation. The exterior of thumbwheel 208 includes knurled surfaces 224 which provide a non-slip functional surface for applying torque to thumbwheel 208. Thumbwheel 208 further includes bushing 234 for slidable engagement with outer pole 106. In an alternate embodiment, thumbwheel 208 is manufactured of a brass, magnesium or aluminum alloy.

Cam 210 is a double-lobed cam which includes trough 236. Cam 210 includes cross receptacle 212. In other embodiments, the cam can have additional lobes to provide more than one biased or "home" position. Cross receptacle 212 engages end 206 of shaft 202 and prevents rotation between shaft 202 and cam 210. In other embodiments, the receptacle can take on other shapes which prevent rotation between shaft 202 and cam 210. Stem 214 extends from an opposite surface of cam 210. Stem 214 rotatably engages lower bracket 104. Cam 210 is free to rotate with respect to lower bracket 104.

Lower bracket 104 comprises legs 242 extending laterally from raised base 240. A plurality of holes 246 and slots 247 provided in legs 242 accommodate mounting screws for attaching lower bracket 104 to the floor of the corner cabinet carcass. Receptacle 244 formed in base 240 receives stem 214. In a preferred embodiment, a vertical thrust bearing resides in receptacle 244 and rotatably supports stem 214. A clearance is provided between cam 210 and base 240 to prevent interference between the cam and the base during rotation. Cam follower frame 248 is rigidly affixed to base 240. Cam follower frame 248 includes deformable cam follower 250 which is sized to releasably engage trough 236. In a preferred embodiment, both cam follower frame 248 and cam 210 are manufactured of a lightweight and deformable but resilient material such as injection molded plastic or polyvinyl chloride (PVC). In other embodiments, the cam is manufactured of a light metal alloy such as brass, magnesium or aluminum.

In use, rotary shelf assembly 100 is installed inside a corner cabinet carcass. Height adjustment assembly 112 provides a "macro" height adjustment to allow rotary shelf assembly 100 to be installed in a range of different height corner cabinets. Height adjustment assembly 110 provides a "micro" height adjustment to fine tune the length of rotary shelf assembly 100 between upper bracket 102 and lower bracket 104 and to ensure proper alignment with the existing cabinet face adjacent to the corner cabinet. When installed, inner pole 108, outer pole 106 and attached shelves 114 and 115, shaft 202, and cam 210 all freely rotate as a single unit 360°, biased in the "home" position. Pressure on the corner cabinet face rotates the corner cabinet face and the shelves about longitudinal axis 124 of the central column.

Upper bracket 102 is mounted to the inside ceiling portion of the corner cabinet carcass. Lower bracket 104 is mounted to the floor portion. Inner pole 108 is rotatably received in upper bracket 102. The cam lock mechanism of height adjustment assembly 112 is released to allow inner pole 108 to slide within outer pole 106. The overall length of rotary shelf assembly 100 is adjusted by advancing or retreating inner pole 108 from outer pole 106. Once stem 214 is rotatably received in receptacle 244, the cam lock mechanism of height adjustment assembly 112 is secured to prevent sliding of the telescopic engagement between inner pole 108 and outer pole 106. Slots 247 allow for lateral adjustment to ensure the central column of rotary shelf assembly 100 is perpendicular to both the ceiling and floor of the corner cabinet carcass. The corner cabinet face is attached to shelves 114 and 115.

Figure 3A:
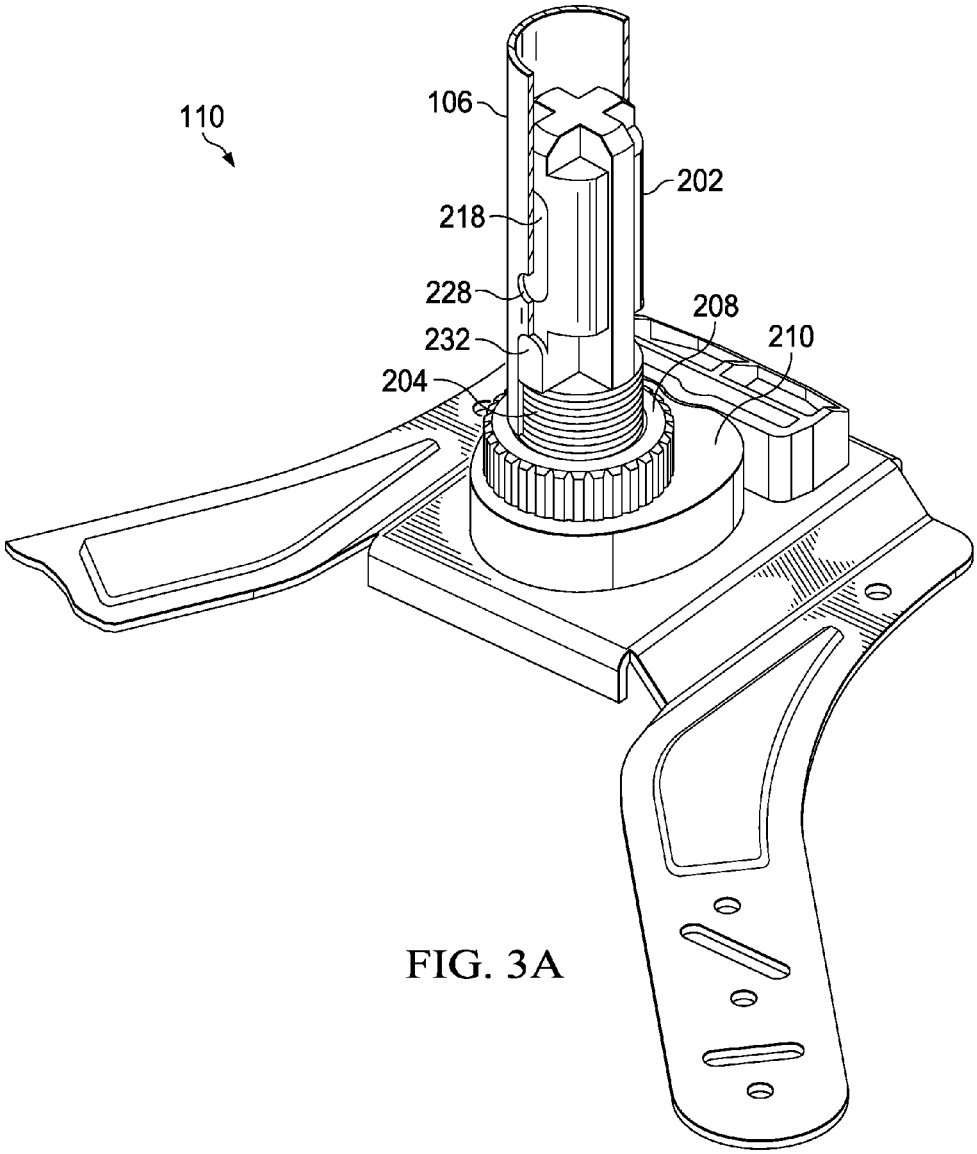
FIG. 3A is a partial cut-away isometric view of a height adjustment assembly.
Figure 3B:
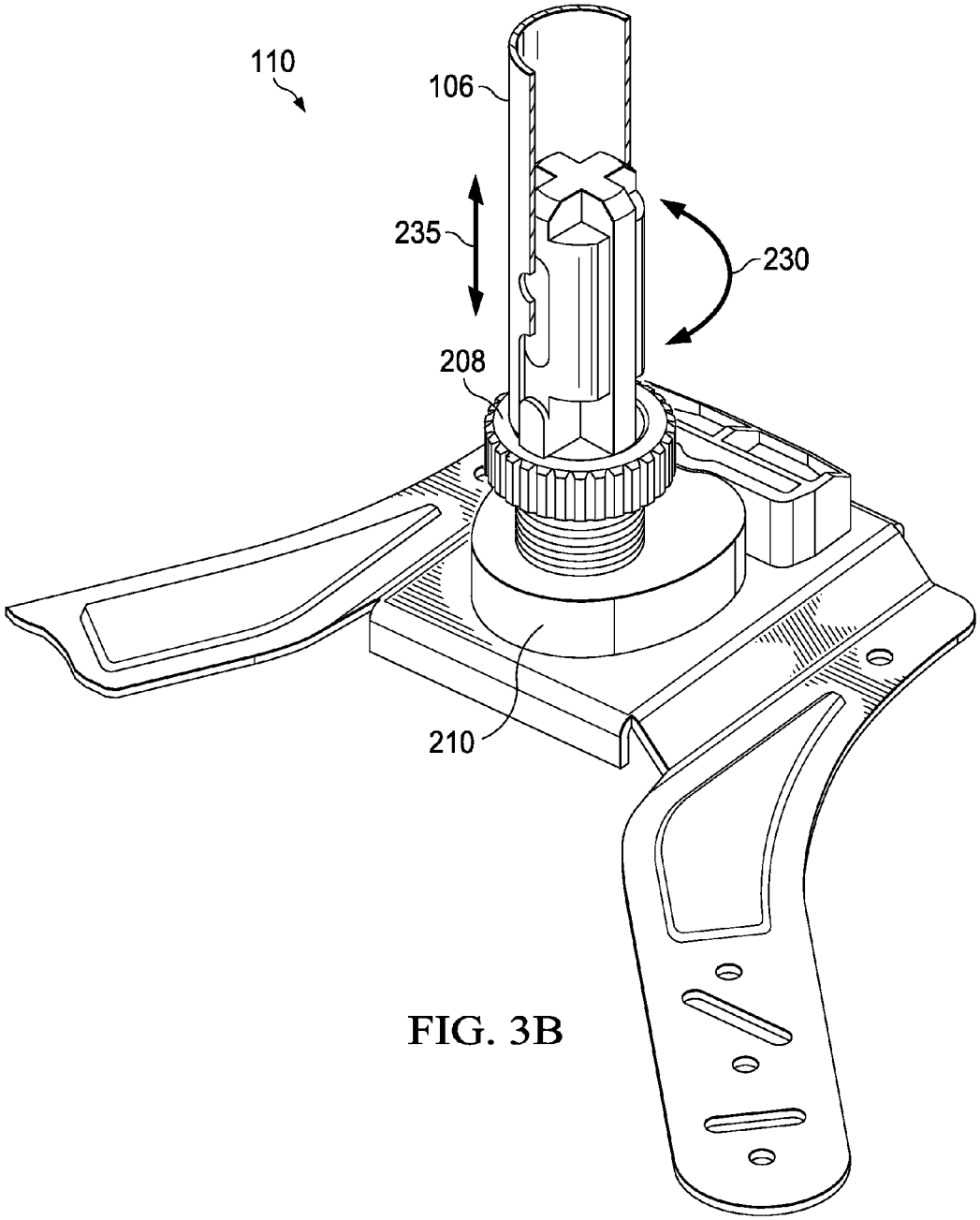
FIG. 3B is a partial cut-away isometric view of a height adjustment assembly showing a vertical adjustment.

Referring to FIGS. 3A and 3B, to fine tune the length of rotary shelf assembly 100 and to adjust the height of the shelves and corner cabinet face, thumbwheel 208 is rotated. Due to the exposed circumference of the thumbwheel, it can be adjusted by hand. Alternatively, since the entire knurled surface of the thumbwheel is exposed, a tool may also be used to rotate the thumbwheel when additional torque is required.

In FIG. 3A, thumbwheel 208 is in its lower most position and is adjacent cam 210. In FIG. 3B, thumbwheel 208 is in its upper most position adjacent tab 232. Rotating thumbwheel 208 clockwise or counter clockwise, shown by direction 230, results in vertical movement up or down threaded section 204, shown by direction 235. As thumbwheel 208 advances up threaded section 204, bushing 234 abuts outer pole 106 and forces outer pole 106 upwards. As thumbwheel 208 retreats down threaded section 204, outer pole 106 follows due to the weight of rotary shelf assembly 100. As outer pole 106 moves vertically, cross-pin 216 slides vertically within slot 218. The range of motion of height adjustment assembly 110 is determined by the length of threaded section 204 or the length of slot 218, whichever is shorter. In a preferred embodiment, threaded section 204 and slot 218 are generally equal in length, approximately 1 to 2 inches.

Figure 4:
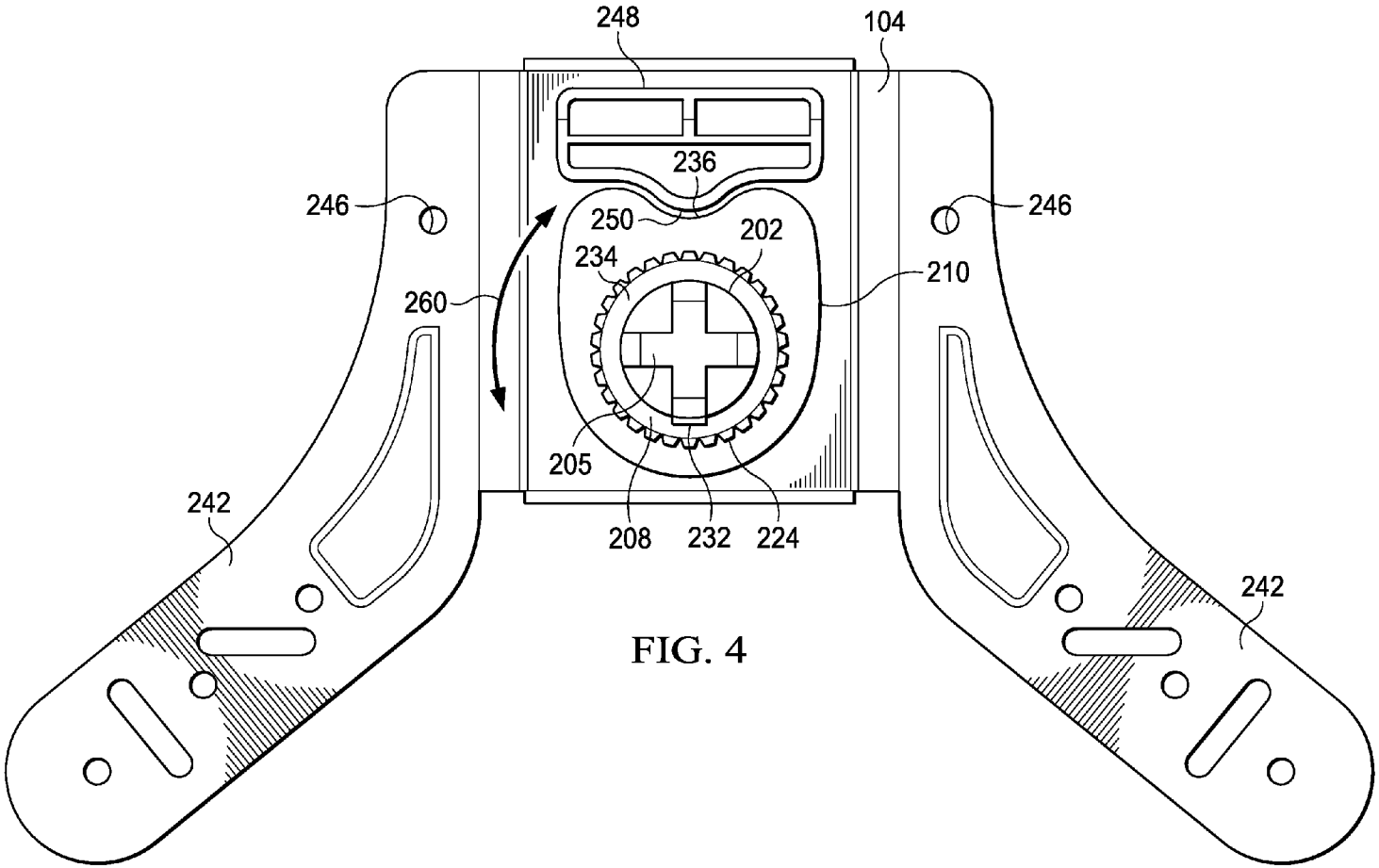
FIG. 4 is a plan view of a height adjustment assembly and a lower bracket.

FIG. 4 shows a plan view of height adjustment assembly 110 and lower bracket 104 in the "home" position. When the rotary shelf assembly is in the "home" position, cam follower 250 is seated in trough 236. Pressure on the corner cabinet face rotates the corner cabinet face and the shelves about longitudinal axis 124 of the central column in direction 260. The elastic nature of cam 210 and cam follower frame 248 frees cam follower 250 from trough 236. Inner pole 108, outer pole 106, shaft 202, and cam 210 rotate together. Therefore, as outer pole 106 rotates, the shelves and the items stored on the shelves also rotate for ease of access.

It will be appreciated by those skilled in the art that changes could be made to the embodiments described above without departing from the broad inventive concept. It is understood, therefore, that this disclosure is not limited to the particular embodiments herein, but it is intended to cover modifications within the spirit and scope of the present disclosure as defined by the appended claims.

The invention claimed is:

1. A rotary shelf assembly for a corner cabinet with a corner cabinet facing comprising:

a central support column rotatably supported by a first bracket;

a shaft, having an integrally formed threaded section, slidably engaged with the central support column;

a thumbwheel threadably engaged with the threaded section and abutting the central support column;

a cam, separable from and removably engaged with the shaft, rotatably supported by a second bracket; and, whereby rotation of the thumbwheel vertically displaces the central support column.

2. The rotary shelf assembly of claim 1 further comprising:

a cam trough defined in the cam;

a stem extending from the cam and rotatably engaged with the second bracket; and, a deformable cam follower, engaged with the cam trough, adjacent the cam and affixed to the second bracket.

3. The rotary shaft assembly of claim 1 further comprising a bushing between the thumbwheel and the central support column.

4. The rotary shelf assembly of claim 1 wherein the central support column is comprised of an inner pole telescopically engaged with an outer pole and a cam lock mechanism releasably connects the inner pole to the outer pole.

5. The rotary shelf assembly of claim 1 wherein the central support column comprises a plurality of opposing holes for adjustable engagement with a cross-pin.

6. The rotary shelf assembly of claim 1 wherein the central support column further comprises an inner pole, rotatable within the first bracket, telescopically engaged with an outer pole rotatable within the second bracket.

7. The rotary shelf assembly of claim 1 further comprising:

a disc shaped shelf removably attached to the central support column; and, the shelf having a cutout.

8. The rotary shelf assembly of claim 1 further comprising:

a shelf attached to the central support column with a cross-pin through a hole in the central support column;

the cross-pin engages a slot in the shaft; and, whereby upon rotation of the thumbwheel, the cross-pin is vertically displaced along the slot and prevents relative rotation between the central support column and the shaft.

9. The rotary shelf assembly of claim 8 wherein the shaft has a first longitudinal axis parallel to a second longitudinal axis of the slot.

10. A rotatable shelving apparatus comprising:

an inner pole rotatable within a first bracket;

an outer pole, having a first end telescopically engaged with the inner pole;

a shaft, having a first end engaged with the outer pole and a second end removably engaged with a cam rotatable within a second bracket;

the shaft comprising a set of threads proximate the second end;

a thumbwheel threadably engaged with the set of threads and adjacent a second end of the outer pole; and, wherein rotation of the thumbwheel alters the position of the thumbwheel with respect to the set of threads, and wherein the outer pole is vertically displaced.

11. The rotatable shelving apparatus of claim 10 further comprising a plurality of shelves removably attached to the outer pole.

12. The rotatable shelving apparatus of claim 10 further comprising a clamp means for releasably adjusting the position of the inner pole with respect to the outer pole.

13. The rotatable shelving apparatus of claim 10 wherein the thumbwheel further comprises a bushing adjacent the outer pole.

14. The rotatable shelving apparatus of claim 10 further comprising:

the cam, having a cam recess, removably coupled to the shaft;

a cam follower frame mounted to the second bracket;

a flexible cam follower extending from the cam follower frame and releasably engaged with the cam recess.

15. A rotary shelf assembly for a corner cabinet with a corner cabinet facing comprising:

a central support column, having a cylindrical base surface defining an end, rotatably supported by a first bracket;

a shaft, having an integrally formed threaded section, slidably engaged with the central support column;

the shaft further defining a radially extending stop tab adjacent the threaded section;

a thumbwheel threadably engaged with the threaded section and supporting the cylindrical base surface;

a cam, engaged with the shaft, rotatably supported by a second bracket;

wherein the thumbwheel has a travel on the threaded section limited by the stop tab; and, wherein rotation of the thumbwheel displaces the cylindrical base surface.

16. The rotatable shelving apparatus of claim 15 wherein the thumbwheel has a cylindrical outer surface that is contactable on all sides.

* * * * *